US005911567A

United States Patent [19]

Martin

[11] Patent Number: 5,911,567

[45] Date of Patent: Jun. 15, 1999

[54] POSITIVE DISPLACEMENT PUMP APPARATUS

[75] Inventor: William Wesley Martin, South Perth, Australia

[73] Assignee: QVP Pty Ltd, Fremantle, Australia

[21] Appl. No.: 08/969,942

[22] Filed: Nov. 25, 1997

Related U.S. Application Data

[63] Continuation of application No. 08/619,604, filed as application No. PCT/AU94/00584, Sep. 30, 1994, Pat. No. 5,795,143.

[30] Foreign Application Priority Data

| | | | |
|---|---|---|---|
| Oct. 1, 1993 | [AU] | Australia | PM1554 |
| Oct. 13, 1993 | [AU] | Australia | PM1754 |

[51] Int. Cl.[6] ..... F04C 2/00

[52] U.S. Cl. ..... 418/58; 418/227

[58] Field of Search ..... 418/225, 227, 418/58

[56] References Cited

U.S. PATENT DOCUMENTS

| | | | |
|---|---|---|---|
| 534,578 | 2/1895 | Reed | 418/227 |
| 621,752 | 3/1899 | Fleak . | |
| 1,444,880 | 2/1923 | Martin . | |
| 1,545,849 | 7/1925 | Reaugh | 418/227 |
| 1,769,079 | 7/1930 | Smith . | |
| 2,919,062 | 12/1959 | Tryhorn | 418/227 |
| 5,069,606 | 12/1991 | Bachellerie | 418/58 |

FOREIGN PATENT DOCUMENTS

| | | | |
|---|---|---|---|
| 0333391 | 9/1989 | European Pat. Off. . | |
| 1178701 | 7/1989 | Japan . | |
| 1517881 | 7/1978 | United Kingdom . | |
| 2145159 | 3/1985 | United Kingdom | 418/227 |
| 93/08403 | 4/1993 | WIPO . | |

*Primary Examiner*—John J. Vrablik
*Attorney, Agent, or Firm*—Venable; Gabor J. Keleman

[57] ABSTRACT

A positive displacement pump apparatus includes a housing formed of a housing wall including a wall portion; a pump center line; a pump drive shaft extending through the wall portion coaxially with the pump center line and having a terminus within the housing adjacent the wall portion; a rotatable disc disposed in the housing adjacent the wall and secured to the terminus to be rotated by the drive shaft about the pump center line; and a vane mounted eccentrically on the disc for travel along a circular arc as the disc rotates. The vane has a vane axis about which the vane rotates relative to the disc; and two opposite, axially spaced first and second radial sides. The vane is mounted on the disc at the first radial side. The vane further has two opposite, radially spaced axial sides. The distance of the vane axis to either of the axial sides is greater than the distance from the pump center line to the vane axis. The vane also has a vane drive shaft extending from the first radial side coaxially with the vane axis. There is further provided a gearing disposed in the housing adjacent the wall portion. The gearing couples the vane drive shaft with the pump drive shaft for rotating the vane about the vane axis, whereby the vane moves, in the circular arc, through a positive displacement portion of movement and a non-positive displacement portion of movement.

8 Claims, 10 Drawing Sheets

POSITIVE DISPLACEMENT PUMP APPARATUS

This is a Continuation of application Ser. No. 08/619,604 filed Apr. 1, 1996, which is a 371 of PCT/Au94/00584 filed Sep. 30, 1994 U.S. Pat. No. 5,795,143.

The present invention relates to a positive displacement pump apparatus. More particularly, the positive displacement pump apparatus of the present invention is applicable for use in Metering fluid flow, power generation, ships propulsion, fans, compressors, artificial heart, pressure regulation, valves and the like.

Pumps presently available, in particular high pressure pumps are disadvantaged by their large size. This large size is demanded by the need to accommodate a large diameter impeller.

In addition, such pumps have a low level of efficiency due to their "non-positive" displacement operation. This is typified by the generally rough or pulsing flow produced in the fluid being pumped.

SUMMARY OF THE INVENTION

It is an object of the invention to overcome or reduce the above-outlined problems associated with the prior art.

This object and others to become apparent as the specification progresses, are accomplished by the invention, according to which, briefly stated, the positive displacement pump apparatus includes a housing formed of a housing wall including a wall portion; a pump center line; a pump drive shaft extending through the wall portion coaxially with the pump center line and having a terminus within the housing adjacent the wall portion; a rotatable disc disposed in the housing adjacent the wall and secured to the terminus to be rotated by the drive shaft about the pump center line; and a vane mounted eccentrically on the disc for travel along a circular arc as the disc rotates. The vane has a vane axis about which the vane rotates relative to the disc; and two opposite, axially spaced first and second radial sides. The vane is mounted on the disc at the first radial side. The vane further has two opposite, radially spaced axial sides. The distance of the vane axis to either of the axial sides is greater than the distance from the pump center line to the vane axis. The vane also has a vane drive shaft extending from the first radial side coaxially with the vane axis. There is further provided a gearing disposed in the housing adjacent the wall portion. The gearing couples the vane drive shaft with the pump drive shaft for rotating the vane about the vane axis, whereby the vane moves, in the circular arc, through a positive displacement portion of movement and a non-positive displacement portion of movement.

BRIEF DESCRIPTION OF THE DRAWINGS

The present invention will now be described, by way of example only, with reference to the accompanying drawings, in which.

DESCRIPTION OF THE INVENTION

In FIGS. 1 to 8 there is shown a positive displacement pump apparatus 10 having a pump center line A and comprising a first vane 12, a second vane 14 and a housing 16.

Figure 3:
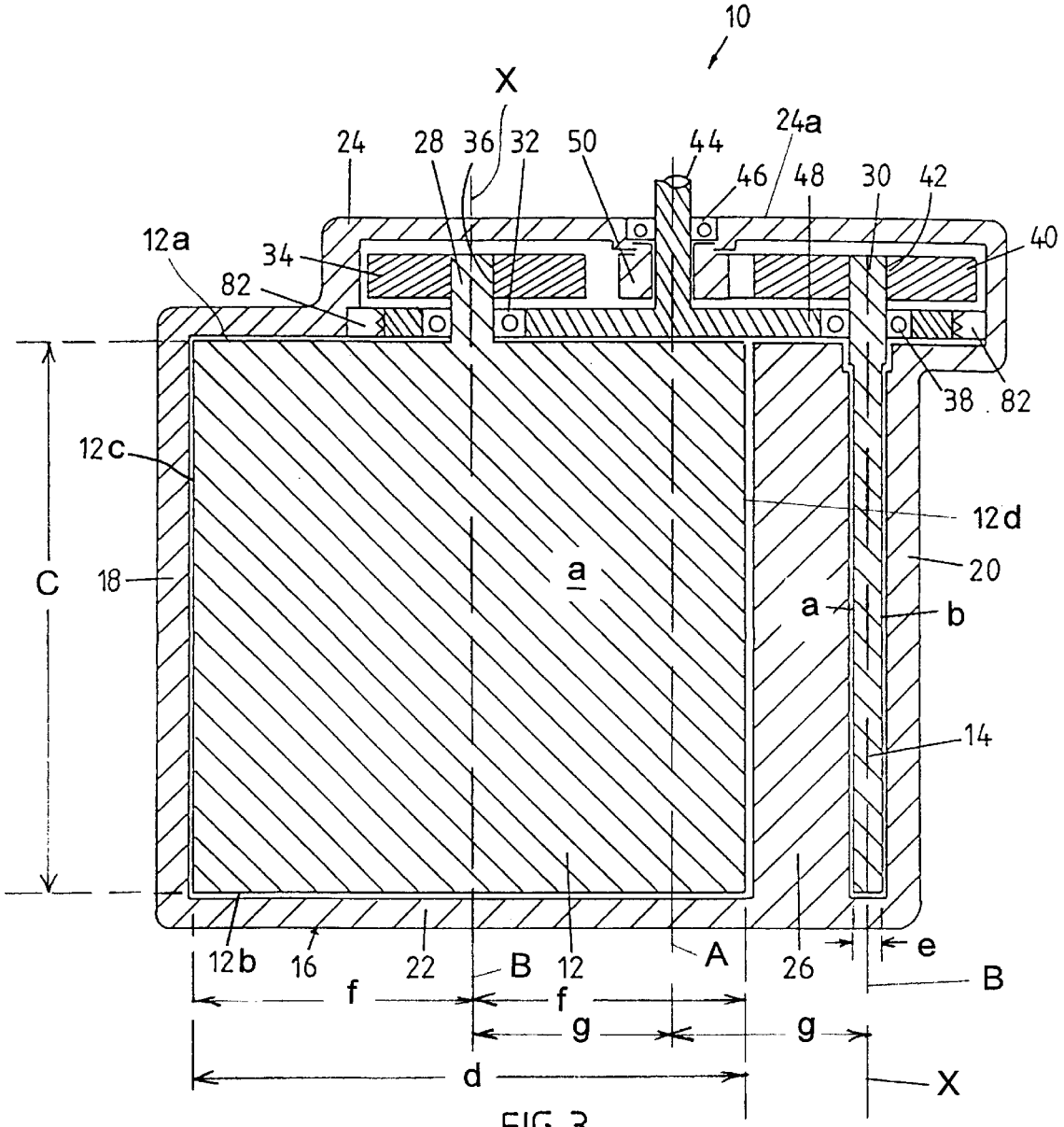
FIG. 3 is a cross-sectional view of the positive displacement pump apparatus of FIG. 1 along line 3—3 showing the entire housing, the raised member and the support means.

The housing 16 comprises side walls 18 and 20, a base 22 and an upper gear housing 24, best seen in FIG. 3. A raised member 26 projects perpendicularly from the base 22, as do the walls 18 and 20.

Each vane 12 and 14 has a drive shaft, 28 and 30 respectively, attached at a mid-point thereon. The shafts 28 and 30 define axes X about which both vanes 12 and 14, and shafts 28 and 30 rotate.

The vanes 12 and 14, as may be observed particularly in FIG. 3, are substantially of the same flat, plate-like configuration, having opposite large faces a, b, four sides designated at 12*a*, 12*b*, 12*c*, and 12*d* for vane 12, a vane axis B coinciding with the axis X of the respective vane shaft 28, 30, an axially measured length c, a radially measured width d and a thickness e. Sides 12*a*, 12*b* are radially extending sides, while sides 12*c*, 12*d* are axially extending sides. As also shown in FIG. 3, the distance f from the vane axis B to either axially extending vane side 12*c* or 12*d* is greater than the distance g between the pump center line A and the vane axis B. Or, stated differently, one half of the radially measured vane width d is greater than the distance g between the pump center line A and the vane axis B. This geometrical relationship means that each vane 12, 14 has a relatively large radial width d, that is, each vane 12, 14 extends, as it rotates, radially beyond the pump center line A.

The shaft 28 projects through a bearing means 32 and has a toothed gear 34 provided on an uppermost portion 36 thereof. The shaft 30 projects through a bearing means 38 and has a toothed gear 40 provided on an uppermost portion 42 thereof. FIG. 3 further shows that the vanes 12, 14 are supported in cantilever fashion, that is, they are supported only by their vane shaft 28, 30 at one radial vane side (side 12*a* in case of vane 12), while no supporting structure is present at the opposite radial vane side (side 12*b* in case of vane 12). Stated differently, each vane is supported solely at one end of its axial length, while the other, opposite end is unsupported. Such an arrangement is particularly advantageous in avoiding lubrication problems and enables the pump to be used with a large number of liquids as diverse as blood, beverages and aqueous mineral slurries.

A drive means, for example a drive shaft 44 is coaxial with the pump center line A and projects through the upper gear housing 24 and a bearing means 46 provided therein and attaches to a drive disc 48. As seen in FIG. 3, the drive shaft 44 extends into the housing 16 through a wall portion 24*a* of the gear housing 24 and terminates adjacent the housing portion 24*a* where it is attached to the disc 48.

The drive shaft 44 has a toothed gear 50 formed thereabouts through a depending projection of the upper gear housing 24. The gear 50 does not rotate as it is formed integrally with the gear housing 24. Two intermediate planetary gears 52 and 54 are provided interconnecting the gears 34 and 40 respectively with the gear 50.

Each vane 12 and 14 has a first end 56 and a second end 58.

Figure 1:
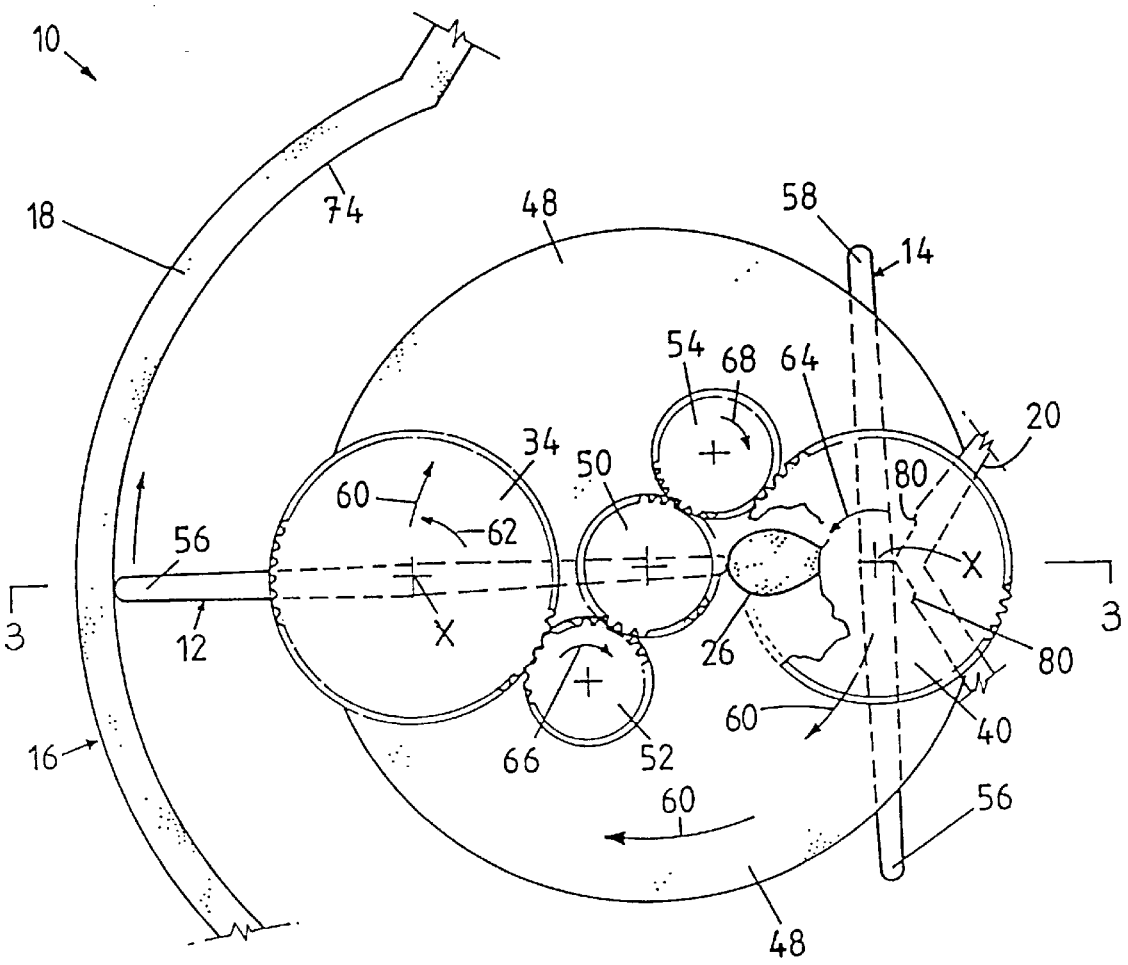
FIG. 1 is a top plan view of a positive displacement pump apparatus in accordance with the present invention showing the housing in part only and showing the gearing thereof in part only.

Rotation of the drive disc 48 is indicated by arrows 60 whilst rotation of the gears 34 and 40 is indicated by arrows 62 and 64 respectively, as can be best seen in FIG. 1. Rotation of intermediate gears 52 and 54 is indicated by arrows 66 and 68 respectively.

Figure 2:
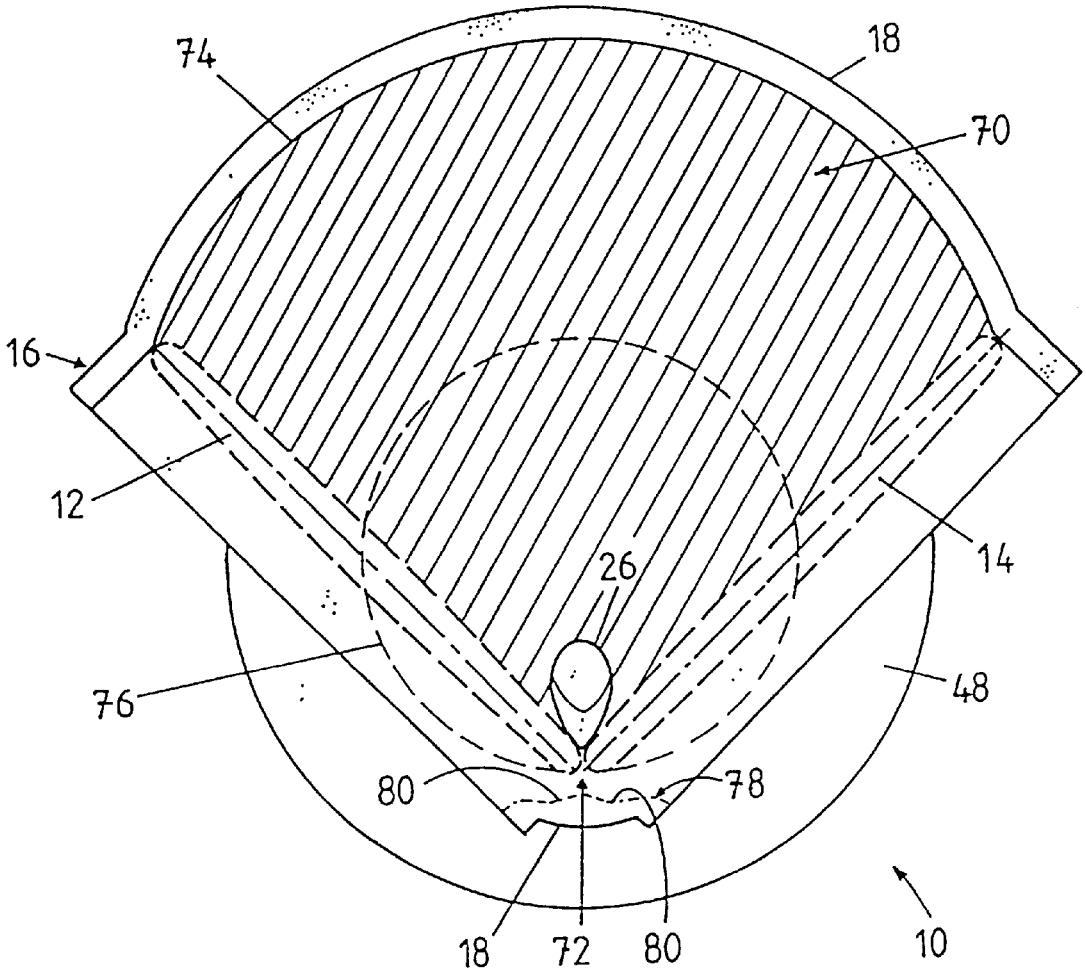
FIG. 2 is a top plan view of the positive displacement pump apparatus of FIG. 1 shown without the gearing and highlighting the positive displacement portion of rotation of the vanes.

The raised member 26 has a cross-section resembling a "tear-drop" as is best seen in FIGS. 1, 2 and 4 to 7. The raised member 26 projects from the base 22 to adjacent the drive disc 48, as can be seen in FIG. 3. The raised member 26 defines with the housing 16 a positive displacement region 70 and a return slot 72, as is shown in FIG. 2.

The portion of the wall 18 bordering the positive displacement region 70 has an inner surface 74 describing an arc whose centre is that of the drive shaft 44.

A circular path 76 is described by the axes X of the shafts 29 and 30 as the drive disc 48 rotates, as is be seen in FIGS. 2 and 4 to 7.

An inner surface 72 of the side wall 20 has provided therein a pair of recesses 80. The slot 72 is defined between the raised member 26 and the inner surface 78.

A seal 82 is provided between the drive disc 48 and the upper gear housing 24, as can be best seen in FIG. 3.

Figure 4:
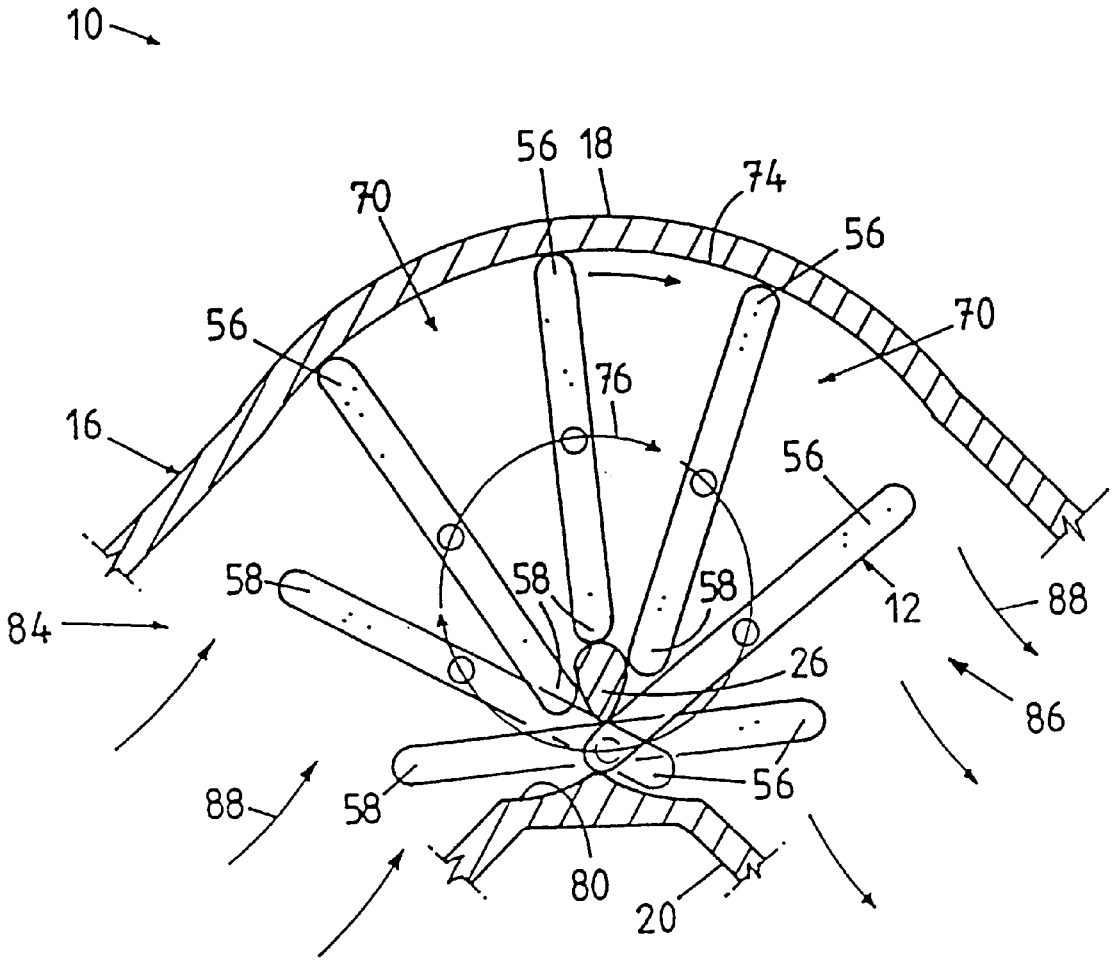
FIG. 4 is a top plan view of the positive displacement pump apparatus of FIG. 2 showing the position of a single vane through a 360° rotation of the support means (or alternatively the position of two vanes through a 90° rotation of the support means)

In FIG. 4, there is shown the positive displacement pump apparatus 10 pumping fluid from an inlet 84 through the positive displacement region 70 and out an outlet 86. The fluid flow is indicated generally by arrows 88.

The path described by a single vane, for example vane 12 is shown in FIG. 4. The path begins for illustrative purposes as the vane 12 enters the positive displacement region 70 with end 56 adjacent the inner surface 74 of the wall 18. The end 58 is at this time adjacent the raised member 26.

The vane 12 is moved clockwise through rotation of the drive disc 48. However, as the vane 12 is moved clockwise gear 52 rotates also in a clockwise manner about fixed gear 50, as indicated by arrow 66 of FIG. 1. The gear 52 in turn engages gear 34 which rotates in an anticlockwise direction, as indicated by arrow 62.

The gear 34 is rigidly connected to the drive shaft 28 and as such the vane 12 is turned in an anticlockwise manner. This allows the vane 12, once it reaches the end of the positive displacement region to begin to slip through the return slot 72. As such however, the end 58 of the vane 12 will be adjacent the inner surface of the wall 18 through the next rotation of the drive disc 48 and the end 56 adjacent the raised member 26.

Figure 5:
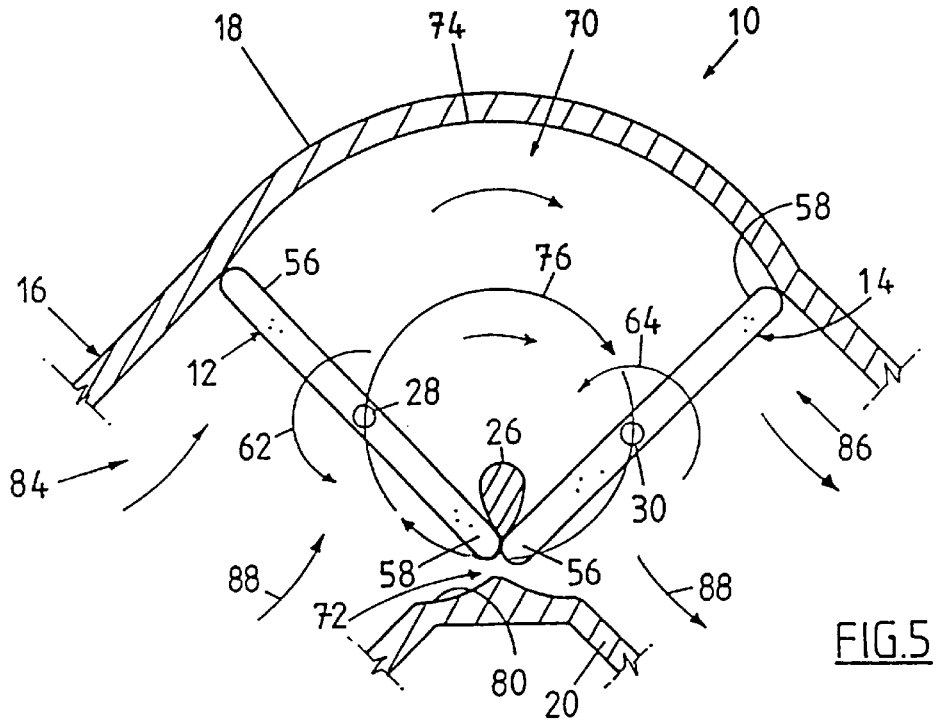
FIG. 5 is a top plan view of the positive displacement pump apparatus of FIG. 2 showing a first position of two vanes.
Figure 6:
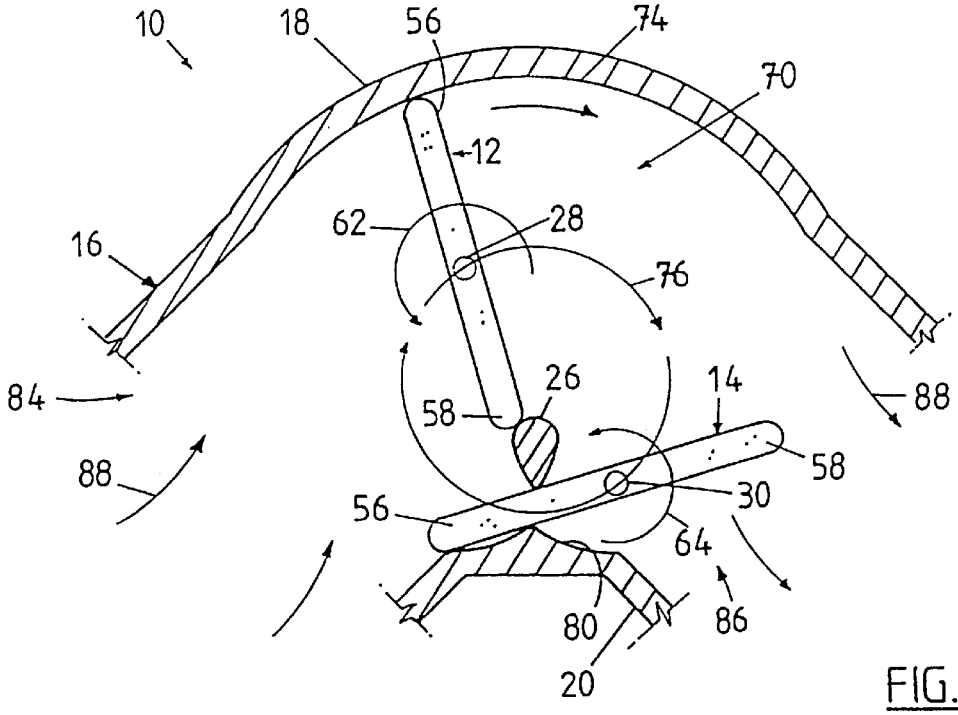
FIG. 6 is a top plan view of the positive displacement pump apparatus of FIG. 5 showing a second position of the two vanes.
Figure 7:
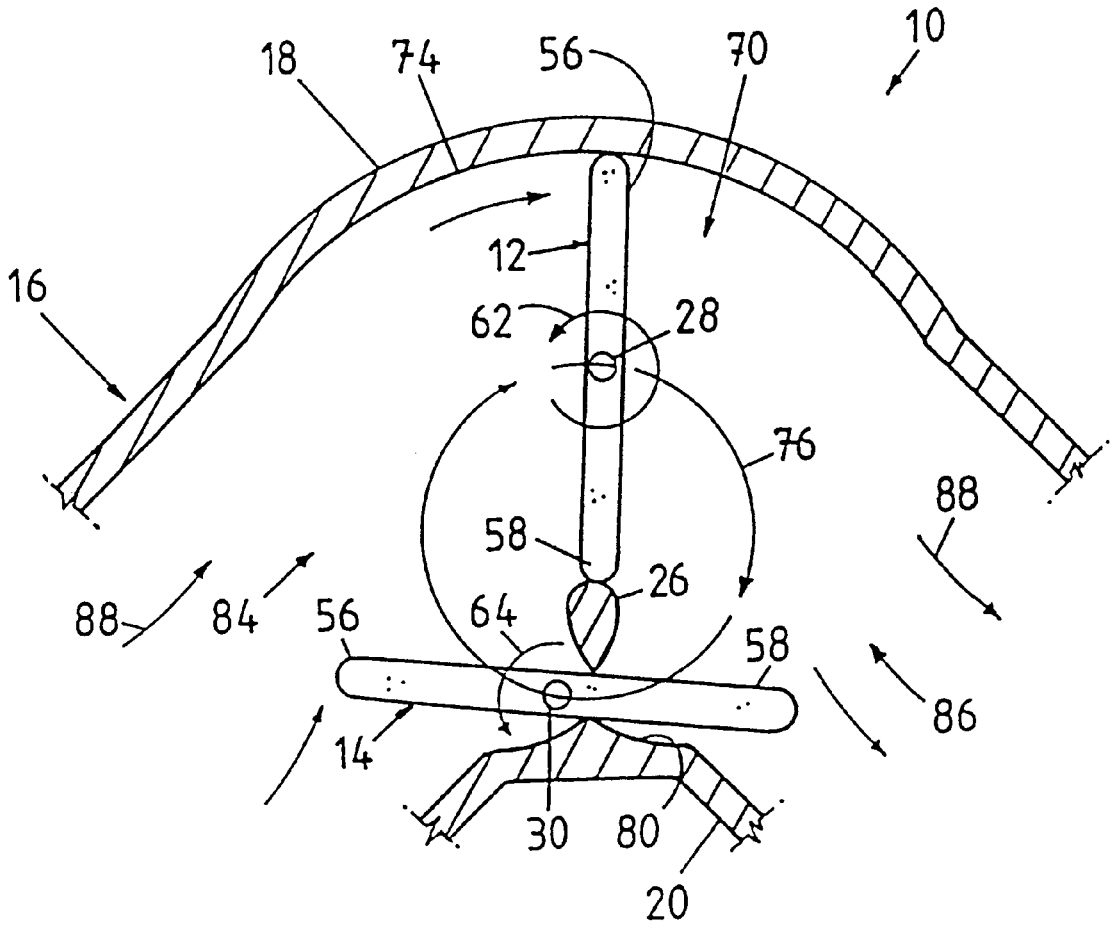
FIG. 7 is a top plan view of the positive displacement pump apparatus of FIGS. 5 and 6 showing a third position the two vanes.

In FIGS. 5 to 7 there is shown the progressive positions of vanes 12 and 14 within the housing 16 driving the pumping of fluid flow 88.

Figure 8:
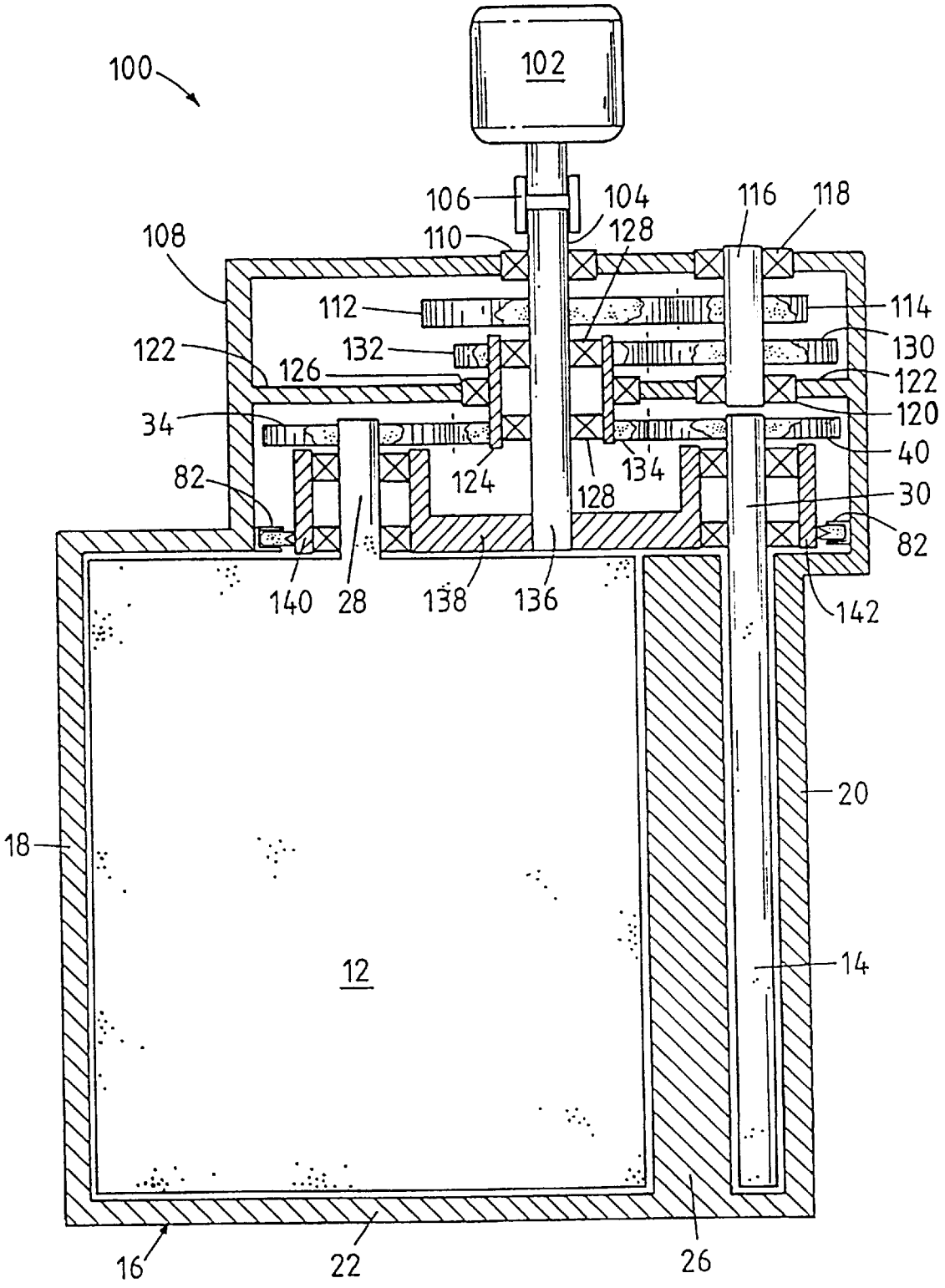
FIG. 8 is a cross-sectional view through a positive displacement pump apparatus in accordance with a second embodiment of the present invention.

In FIG. 8 there is shown a positive displacement pump apparatus 100 in accordance with a second aspect of the present invention. The positive displacement pump apparatus 100 is substantially similar to the positive displacement pump apparatus 10 and like numerals denote like parts.

A drive motor 102 is provided atop a drive shaft 104 which incorporates a coupling 106. The drive shaft 104 projects into a gear housing 108 provided on the housing 16 through a bearing 110.

The drive shaft 104 has fixedly attached thereto a gear 112 which in turn engages a gear 114 fixedly attached to an idler shaft 116. The idler shaft 116 is located within the gear housing 108 and projects in a parallel manner to the drive shaft 104. The idler shaft 116 is held in the gear housing 108 by a bearing 118 at an upper end thereof and by a bearing 120 at a lower end thereof provided in an intermediate plate 122.

An intermediate housing 124 is held by a bearing 126 in the intermediate plate 122 which in turn has the drive shaft 104 held therein by bearings 128.

A further gear 130 is located on the idler shaft 116 which engages an upper gear 132 fixedly attached to the intermediate housing 124. A lower gear 134 fixedly located on the intermediate housing 124, below the intermediate plate 122, engages gears 34 and 40 which in turn are rigidly connected to vanes 12 and 14 respectively.

At a lowermost end 136 of the drive shaft 104 is provided a support means, for example a drive disc 138 rigidly connected thereto. The shafts 28 and 30 of the vanes 12 and 14 are supported in drive housings 140 and 142 respectively. A number of bearings 144 are provided in each housing 140 and 142 to support the shafts 28 and 30.

In use, the positive displacement pump apparatus 10 of the present invention is intended for use in the pumping of a fluid in a substantially continuous or non-pulsing flow. For example, the pump apparatus 10 may be installed in-line such that fluid can enter through the inlet 84 and ultimately exit through the outlet 86, as can be seen in FIGS. 4 to 7.

In order to achieve the pumping action of the pump apparatus 10 of the present invention, a rotational drive is applied to the drive shaft 44 which is in turn transferred to the drive disc 48, as can be seen in FIG. 3. The direction of rotational drive applied to the drive shaft 44 will determine which way the drive disc 48 rotates and in turn which way the vanes 12 and 14 rotate and ultimately the direction in which the fluid is pumped through the pump apparatus 10. For the present purposes, the rotational drive is applied in a clockwise direction, as can be seen with reference to FIG. 1 and FIGS. 4 to 7.

The clockwise rotation of the drive disc 48 indicates by arrows 60 causes a consequent rotation of each vane 12 and 14 also in a clockwise direction about an axis described by the dive shaft 44. This action causes the gears 34 and 40 atop the shafts 28 and 30 of the vanes 12 and 14 respectively to be rotated in an anti-clockwise manner as indicated by arrows 62 and 64 in FIG. 1. This action is achieved through the intermediate planetary gears 52 and 54 engaging the fixed gear 50. As such, the vanes 12 and 14 are moving in a clockwise manner about the axis described by the drive shaft 44 whilst the vanes 12 and 14 individually rotate in an anit-clockwise manner about their axes X described by their shafts 28 and 30 respectively.

The seal 82 provided between the drive disc 48 and the housing 16 prevents any of the fluid being pumped entering the upper gear housing 24, as can be seen most clearly in FIG. 3.

As is perhaps best described with reference to FIGS. 5 to 7, the vane 12 enters the positive displacement region 70 (and consequently the positive displacement portion of rotation) as the vane 14 enters the return slot 72 (and consequently the non-positive portion of rotation). This instance is clearly illustrated in FIG. 5. At this time, a first end 56 of the vane 12 is immediately adjacent the inner surface 74 of the side wall 18 whilst the second end 58 of the vane 12 is adjacent or substantially abuts the raised member 26. At is time, the first end 56 of the vane 14 is adjacent or substantially abuts the raised member 26 whilst the second end 58 of the vane 14 is adjacent the inner surface 74 of the side wall 18 at a point near the outlet 86.

As the drive disc 48 rotates about the drive shaft 44 in a clockwise manner, the axes X of the shafts 28 and 30 of the vanes 12 and 14 respectively describe the circular path 76. In FIG. 6, the vane 12 is moving further into the positive displacement region 70 and the first end 56 of the vane 12 is still adjacent the inner surface 74 of the side wall 18, although at a point closer to the outlet 96. Further, the second end 56 of the vane 12 is also adjacent tee raised member 26. At this time, the first end 56 of the vane 14 has passed through the return slot 72 and is subsequently within the non-positive displacement portion of rotation. The end 56 of the vane 14 is able at first to pass through the return slot 72 because of the recess 80 allowing some rotation of the vane 14 as it passes through the return slot 72. At this point, the vane 14 presents very little surface area as resistance to the flow 88 of the liquid and could said to be presenting a thinner profile to the on-coming flow 88 of fluid. However, the vane 12 in the positive displacement region 70 is provided substantially perpendicular to the flow 88 of fluid through the cavity described within the housing 16.

The ability of vane 14 to move through the return slot 72 at the correct angle to take advantage of the recesses 80, is achieved through the independent rotation of the vane 14 about axis X described by its shaft 30.

As the drive disc 48 continues to rotate in a clockwise manner, the arrangement show in FIG. 7 is reached. At this point, the vane 12 is further into the positive displacement portion of rotation, whilst the first end 56 of the vane 14 has passed entirely through the return slot 72 and the second end 58 of the vane 14 is in the process of passing through the return slot 72. As can be observed from FIG. 7, the second end 58 of the vane 14 will subsequently move adjacent to the recess 80 as the vane 14 passes entirely through the return slot 72. It should be observed that the vane 14 is still at this point presenting a thin profile to the flow 88 of fluid through the inlet 84. At no point in rotation does either vane 12 or 14 present an impediment to the flow 88.

As the drive disc 48 rotates further in a clockwise direction, the subsequent independent rotation of the vanes 12 and 14 about their axes X ensures that upon a 360° rotation of the drive disc 48, each vane 12 and 14 has undergone a 180° rotation in the opposition direction.

The "tear-drop" profile of the raised member 26 when viewed in a top plan view (for example FIGS. 4 to 7) is important in its co-operation with the surface of the vanes 12 and 14 as they rotate independently of the drive disc 48.

It is envisaged that the pump apparatus 10 of the present invention could utilise more than two vanes. When the pump apparatus 10 has two vanes, for example as described hereinabove, the vanes are set at an angle to each other of substantially 90° and are provided at opposite points of the drive disc 44. However, if three vanes are to be provided, these would be set substantially at 60° to each other and at points equidistant apart on the drive disc 44. Still further, if four vanes were to be provided, they would be set at substantially 45° to each other and would be located equidistant from each other on the drive disc 44.

It should be noted that the length of the vanes 12 and 14 between their ends 56 and 58 is such that as one vane leaves the return slot 72, the other vane is entering the return slot to reduce the amount of any back flow (or flow of the fluid from the outlet 86 to the inlet 84). This is the case even if more than two vanes are provided. The tapered profile of the vanes 12 and 14 shown in top plan view in FIGS. 1 and 2 may be used to increase the strength of the vanes 12 and 14 and to reduce their weight. This is preferable in situations of high velocity operation. It is further envisaged that the end 56 and 58 of each vane may be "wedge" shaped so as to maximise the maintenance of the seal to back flow of the fluid during the time when one vane leaves the return slot 72 and the other vane enters the return slot.

The in-use operation of the positive displacement pump apparatus 100 is substantially the same as that of the positive displacement pump apparatus 10 in that the path described both by the drive disc and the vanes 12 and 14 is the same, whereas gearing used to achieve such movement differs.

Rotary drive from the drive motor 102 is transferred to the drive shaft 104 which in turn rotates the drive disc 138. Still further, the rotation of the drive disc 138 moves the vanes 12 and 14 to describe the path 76 shown in FIGS. 2 and 4 to 7. However, the gear 112 is fixedly and rigidly attached to the drive shaft 104 such that rotation thereof consequently produces rotation in the gear 114 at a ratio of 1:1.5 such that the idler shaft 116 rotates at 1.5 times the speed of the drive motor 102. The gear 130 drives the gear 132 at 1:1 ratio. The gear 132 rotates the intermediate housing 124 and 1.5 times motor speed. The lower gear 134 fixedly located on the intermediate housing 124 in turn drives the gears 34 and 40 of the shafts 28 and 30 of the vanes 12 and 14 respectively at a 1:1 ratio.

Figure 9:
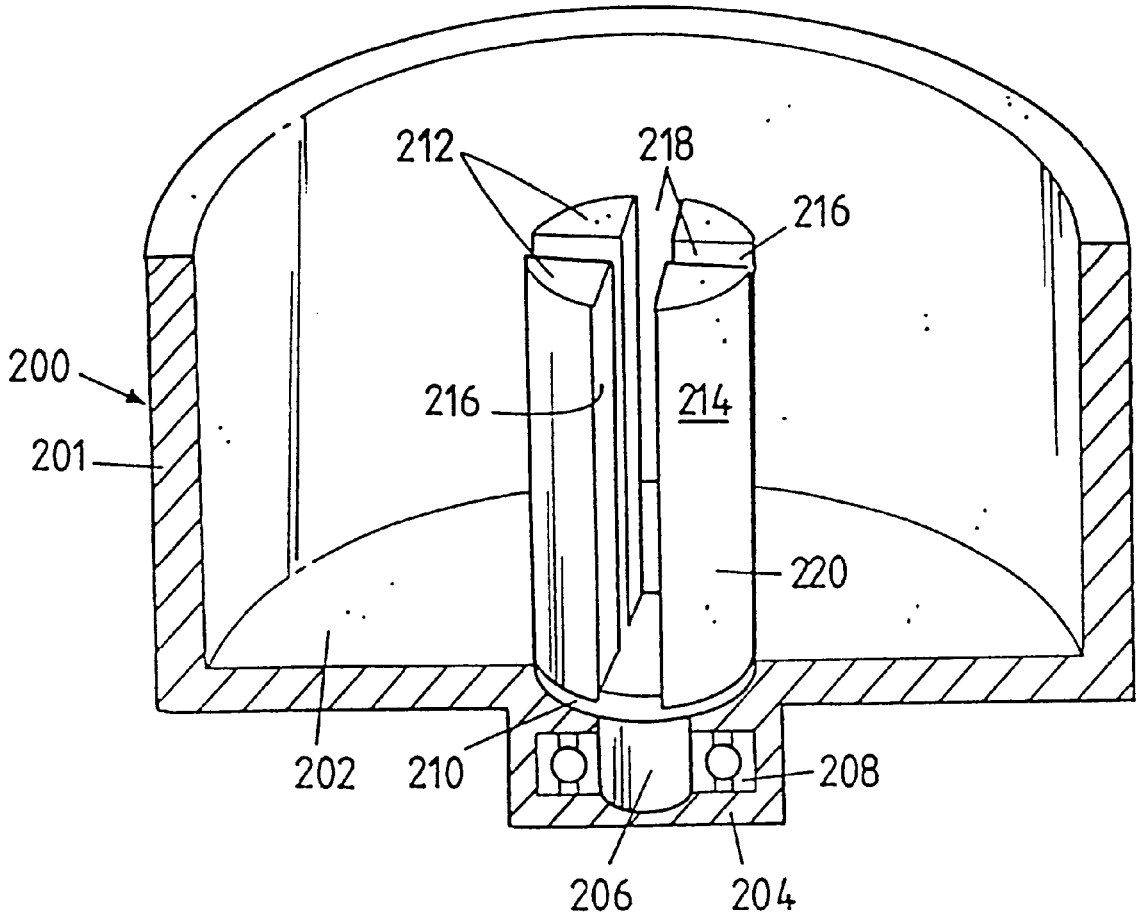
FIG. 9 is am upper perspective sectional view through a housing of a positive displacement pump apparatus in accordance with a third embodiment of the present invention.
Figure 10:
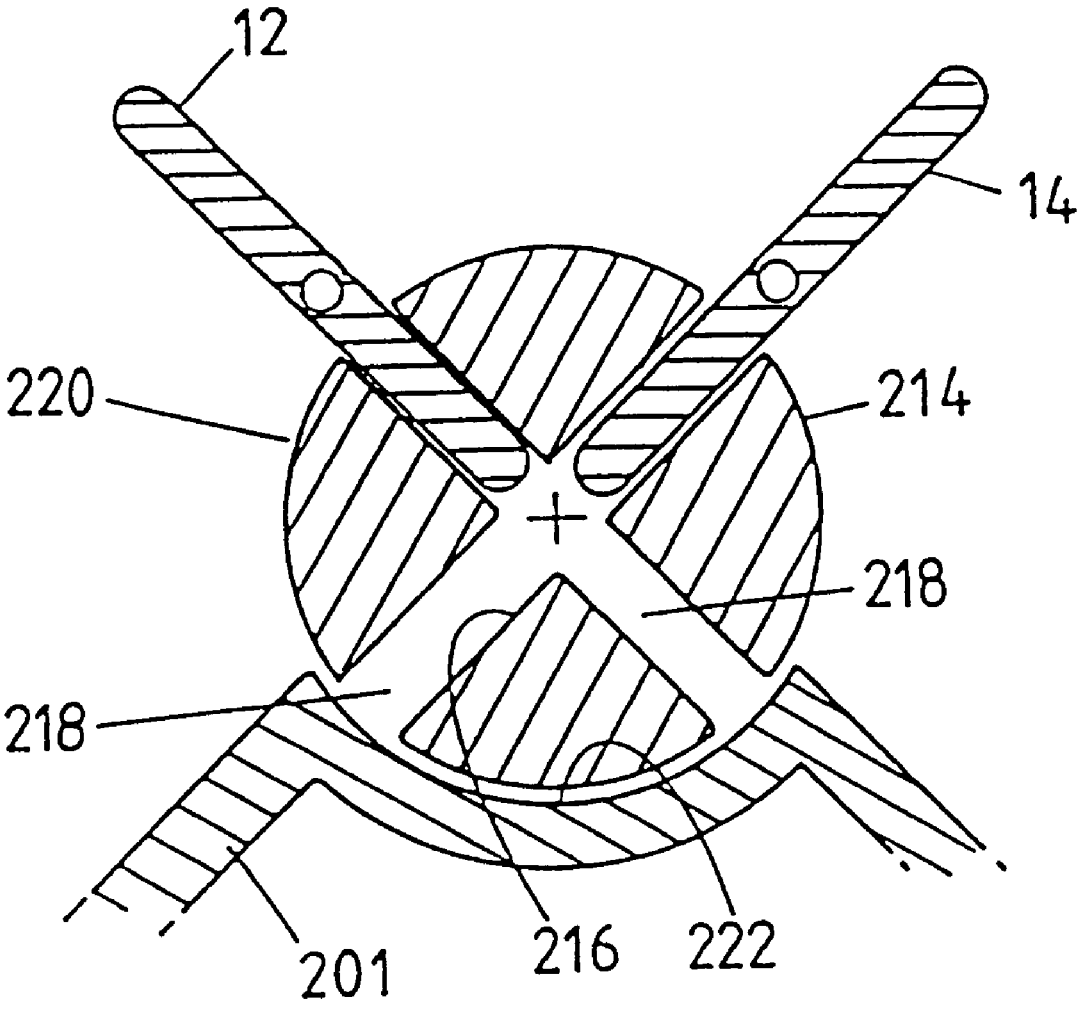
FIG. 10 is a sectional view through a part of the housing and an idler roller of FIG. 9.

In the pump apparatus of the present invention it is possible to replace the raised member 26 with an idler roller and such a construction is shown in FIGS. 9 and 10. In FIGS. 9 and 10 there is shown part of a pump housing and an idler roller. In other respects the pump apparatus of FIGS. 9 and 10 is similar to the pump apparatus of FIGS. 1 to 7. As can be seen in FIG. 9, the pump apparatus 200 of this embodiment includes a housing 201 comprising a base 202. The base 202 is provided with a recess 204. Located within the recess 204 is an axially rotatable shaft 206 mounted in bearing means 208. A recessed disc 210 is mounted on top of the shaft 206 at a level substantially co-planar with the base 202. Four quadrant shaped members 212 are mounted in respective recesses in the disc 210 and are upstanding from the disc 210. The quadrant shaped members 212 have curved outer sides 214 and straight inner sides 216. The inner sides 216 of each quadrant shaped member 212 are spaced from the inner sides 216 of adjacent quadrant shaped members 212 so that a pair of crossed slots 218 are defined by the quadrant shape members 212. The four quadrant shaped members 212 define an idler roller 220. The top of the idler roller 220 is located just below the drive disc 48 shown in FIGS. 1 to 7.

As can be seen in FIG. 10, the idler roller 220 is located in a recess 222 in the housing 201 of complementary shape to the roller 220. The vanes 12 and 14 pass through the slots 218 of the idler roller 220 during the operational cycle described hereinabove in relation to FIGS. 1 to 7 instead of passing around the raised member 26.

The provision of the idler roller 220 avoids the appearance of a gap in the return slot 72 of FIGS. 1 to 7 which occurs when the raised member 26 is used. Thus, the pump construction shown in FIGS. 9 and 10 can be used with higher gas pressure without a return pulse occurring when a gap appears.

Figure 11:
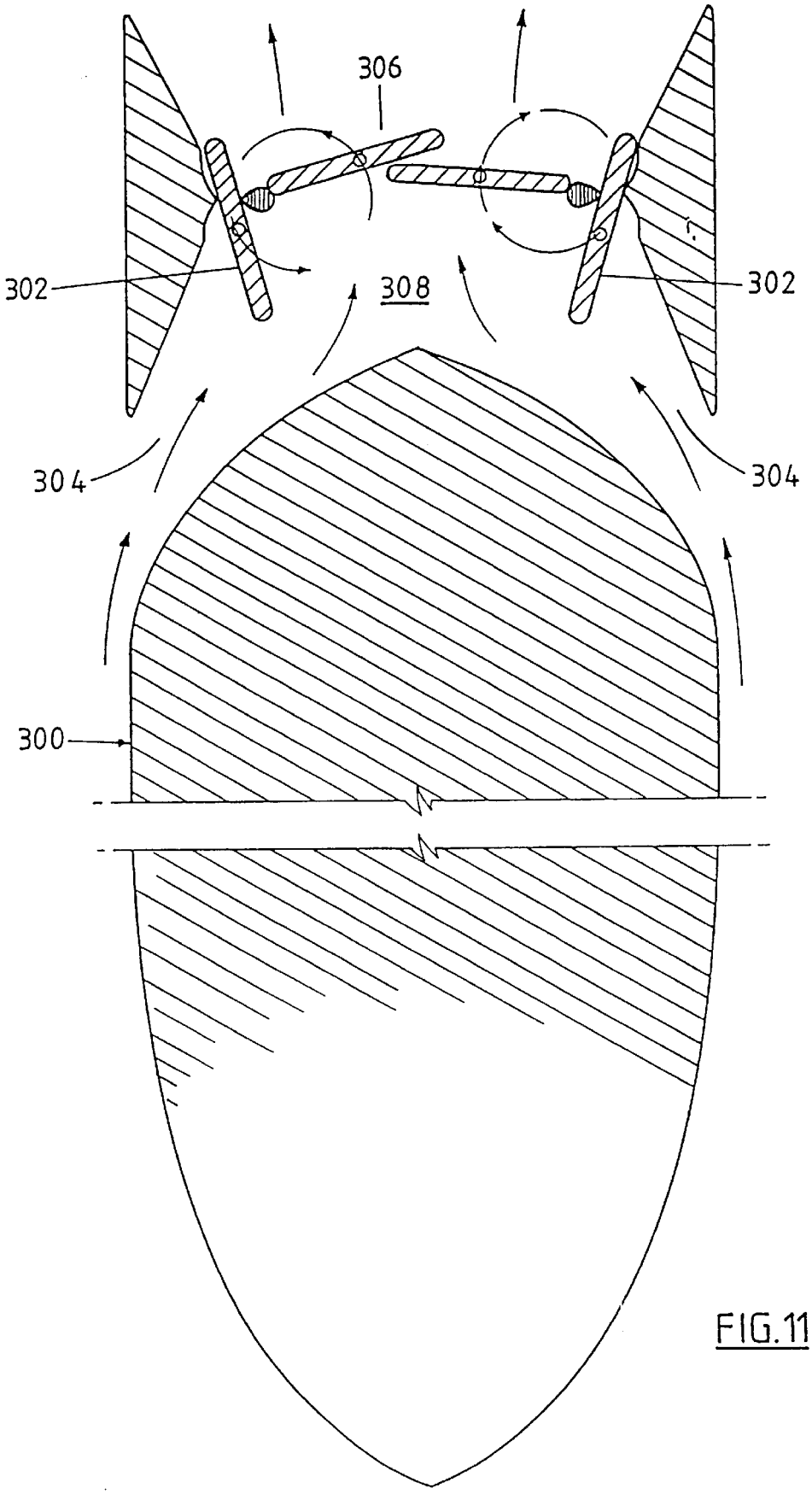
FIG. 11 is a schematic plan view of a ship's hull showing the use of pumps in accordance with the present invention in ship propulsion.

In FIG. 11 there is shown a ship's hull 300 provided with two opposing pump apparatuses 302 in accordance with the present invention as shown in FIGS. 1 to 7. The pump apparatuses 302 operate in the same manner as the pump apparatus of FIGS. 1 to 7 and are contra rotating.

The ship's hull 300 is provided with laterally disposed water inlets 304 and a rearwardly disposed water outlet 306. The rear portion of the hull 300 defines a housing 308 and the pumps 302 are mounted to opposite sides of the housing 308.

Positive displacement thrust is caused by synchronising the pump 302 so that the vane tips almost touch each other during thrust as shown in FIG. 11. It is envisaged that the vane tips may flex to give improved efficiency.

It is envisaged at the positive displacement pump apparatus of the present invention may be manufactured at a greatly reduced size compared to the pumps presently available through dispensing with the need to accommodate large diameter impellers. The rough or pulsing flow produced by most prior art pumps is substantially avoided in the positive displacement pump apparatus of the present invention.

It is further envisaged that the positive displacement pump apparatus of the present invention is applicable for use in metering fluid flow, power generation, fans, compressors, artificial heart applications, pressure regulation, valves and other similar apparatus or devices where it is desirable to have a smooth flow of fluid and in which the ability to minimise the size of the pump is preferred.

Modifications and variations such as would be apparent to a skilled addressee are deemed to be within the scope of the present invention.

I claim:

1. A positive displacement pump apparatus comprising:

(a) a housing formed of a housing wall including a wall portion;

(b) a pump center line extending through said housing;

(c) a pump drive shaft extending through said wall portion coaxially with said pump center line and having a terminus within said housing adjacent said wall portion;

(d) a rotatable disc disposed in said housing adjacent said wall and being secured to said terminus to be rotated by said drive shaft about said pump center line;

(e) a vane arranged eccentrically relative to said disc for travel along a circular arc as the disc rotates; said vane having:

(1) a vane axis; said vane being rotatable relative to said disc about said vane axis;

(2) two opposite, axially spaced first and second radial sides; and (3) two opposite, radially spaced axial sides; a distance of said vane axis to either of said axial sides being greater than a distance of said pump center line to said vane axis;

(f) means for supporting said vane eccentrically relative to said disc such that said first radial side is oriented towards said disc;

(g) means for driving said vane for rotation about said vane axis; and (h) a raised member disposed in said housing; said raised member defining, together with said housing, a positive displacement region and a return slot.

2. A positive displacement pump apparatus comprising:

(a) a housing formed of a housing wall including a wall portion;

(b) a pump center line extending through said housing;

(c) a pump drive shaft extending through said wall portion coaxially with said pump center line and having a terminus within said housing adjacent said wall portion;

(d) a rotatable disc disposed in said housing adjacent said wall and being secured to said terminus to be rotated by said drive shaft about said pump center line;

(e) a vane mounted eccentrically on said disc for travel along a circular arc as the disc rotates; said vane having:

(1) a vane axis; said vane being rotatable relative to said disc about said vane axis;

(2) two opposite, axially spaced first and second radial sides; said vane being mounted on said disc at said first radial side;

(3) two opposite, radially spaced axial sides; a distance of said vane axis to either of said axial sides being greater than a distance of said pump center line to said vane axis; and (4) a vane drive shaft extending from said first radial side coaxially with said vane axis;

(f) a gearing disposed in said housing adjacent said wall portion; said gearing coupling said vane drive shaft with said pump drive shaft for effecting rotation of said vane about said vane axis, whereby said vane moves, in said circular arc, through a positive displacement portion of movement and a non-positive displacement portion of movement; and (g) a raised member disposed in said housing; said raised member defining, together with said housing, a positive displacement region and a return slot.

3. The positive displacement pump apparatus as defined in claim 2, wherein said gearing is arranged such that said vane and said disc rotate in opposite directions.

4. The positive displacement pump apparatus as defined in claim 2, further comprising an inner wall disposed in said housing; and wherein said gearing is arranged such that for each 360° rotation of the disc said vane executes a 180° rotation so that one of said axial sides of said vane being initially adjacent said inner wall will be remote therefrom after a 360° rotation of said disc.

5. The positive displacement pump apparatus as defined in claim 2, wherein said positive displacement region and said return slot are so arranged that said vane is in the positive displacement portion of movement through the positive displacement region of said housing and in the non-positive displacement portion of movement through said return slot.

6. The positive displacement pump apparatus as defined in claim 2, wherein said vane is a first vane and said vane axis is a first vane axis; further comprising a second vane mounted eccentrically on said disc for travel along a circular arc as the disc rotates; said second vane having a second vane axis and being rotatable relative to said disc about said second vane axis; and said gearing coupling said second vane with said drive shaft for effecting rotation of said second vane about said second vane axis, whereby said second vane moves, in said circular arc, through a positive displacement portion of movement and a non-positive displacement portion of movement; said first and said second vanes being arranged with respect to one another such that as one of said first and second vanes enters said positive displacement portion of movement, the other of said first and second vanes enters said non-positive displacement portion of movement for reducing reverse flow of a fluid being pumped through said housing.

7. The positive displacement pump apparatus as defined in claim 6, wherein a full profile of said vane is oriented substantially perpendicularly to a direction of flow of fluid through said housing in said positive displacement portion of movement and a less than full profile is oriented to the direction of flow through said return slot in said non-positive displacement portion of movement.

8. The positive displacement pump apparatus as defined in claim 2, wherein said vane is unsupported at said second radial side, whereby said vane is mounted in a cantilever manner on said disc.

* * * * *